US008978682B2

(12) United States Patent
Belzner et al.

(10) Patent No.: US 8,978,682 B2
(45) Date of Patent: Mar. 17, 2015

(54) EMERGENCY SHUT-OFF SIGNAL GENERATOR FOR A VALVE ASSEMBLY

(75) Inventors: Andreas Belzner, Bad Saeckingen (DE); Dirk Matthes, Mellingen (CH)

(73) Assignee: Alstom Technology Ltd, Baden (CH)

( * ) Notice: Subject to any disclaimer, the term of this patent is extended or adjusted under 35 U.S.C. 154(b) by 336 days.

(21) Appl. No.: 13/472,624

(22) Filed: May 16, 2012

(65) Prior Publication Data

US 2013/0061953 A1 Mar. 14, 2013

(30) Foreign Application Priority Data

May 18, 2011 (CH) ..... 841/11

(51) Int. Cl.
*G05D 7/00* (2006.01)
*F15B 20/00* (2006.01)

(52) U.S. Cl.
CPC ..... *F15B 20/008* (2013.01)
USPC ..... 137/1; 137/485; 137/613

(58) Field of Classification Search
USPC ..... 137/1, 613, 485
See application file for complete search history.

(56) References Cited

U.S. PATENT DOCUMENTS 4,857,762 A 8/1989 Gaebel
5,588,464 A * 12/1996 Tylosky ..... 137/613

FOREIGN PATENT DOCUMENTS

DE 3309431 A1 9/1984
EP 0269818 A1 6/1988
EP 1593893 A1 11/2005
GB 2128007 A 4/1984
JP 2008138716 A 6/2008

OTHER PUBLICATIONS

European Patent Office, Search Report in Swiss Patent Application No. CH 841/2011 (Sep. 27, 2011).
European Patent Office, Search Report Application No. 12167959.1 (Sep. 4, 2012).

* cited by examiner

*Primary Examiner* — Kevin Lee
(74) *Attorney, Agent, or Firm* — Buchanan Ingersoll & Rooney PC

(57) ABSTRACT

A control system includes a first valve configured to block a fluid flow between a first section of a flow line and a second section of the flow line in response to a first emergency shut-off signal of a first signal type. A second valve is configured to block the second section of the flow line and a third section of the flow line in response to a second emergency shut-off signal of a second signal type, wherein the first signal type differs from the second signal type.

13 Claims, 2 Drawing Sheets

EMERGENCY SHUT-OFF SIGNAL GENERATOR FOR A VALVE ASSEMBLY

CROSS-REFERENCE TO PRIOR APPLICATIONS

Priority is claimed to Swiss Patent Application No. CH 00841/11, filed on May 18, 2011, the entire disclosure of which is hereby incorporated by reference herein.

FIELD

The present invention relates to a control system as well as a method for upgrading a control system, in particular with respect to providing emergency shut-off capabilities, e.g. for emergency shut-off of a steam or gas-powered turbine.

BACKGROUND

A flow of fluid, e.g. steam or gas, can be provided to a turbine as a source of power or fuel. Such turbines find use in a variety of applications, for example in electrical power plants.

To regulate the amount of fluid flowing to the turbine, it is common to provide a valve in a fluid line leading to the turbine. A control circuit, which incorporates e.g. a closed loop controller or an open loop controller, supplies a control signal, in response to which control signal the valve opens to a corresponding degree.

SUMMARY

In an embodiment, the present invention provides a control system. A first valve is configured to block a fluid flow between a first section of a flow line and a second section of the flow line in response to a first emergency shut-off signal of a first signal type. A second valve is configured to block the second section of the flow line and a third section of the flow line in response to a second emergency shut-off signal of a second signal type, wherein the first signal type differs from the second signal type.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
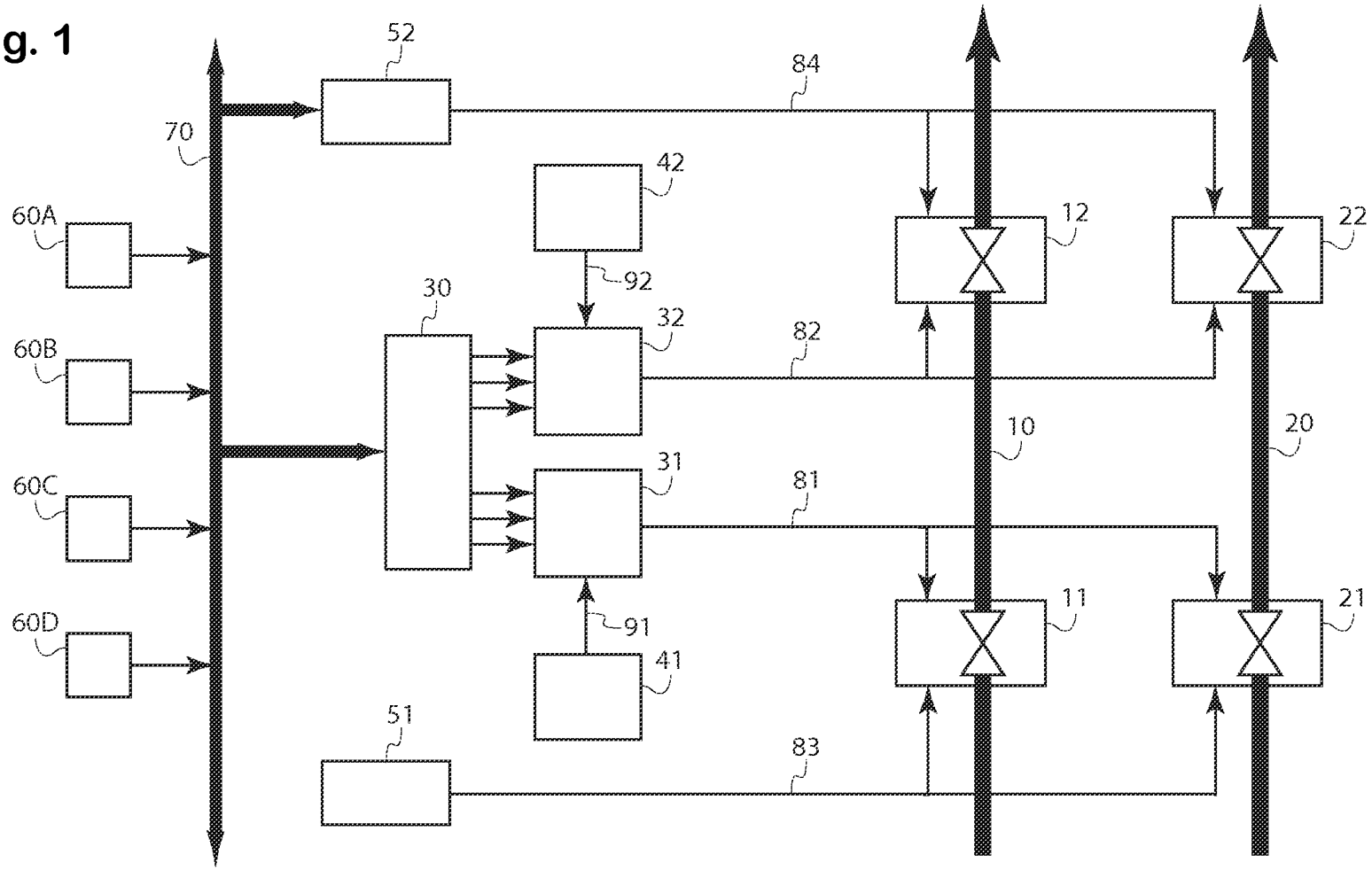
FIG. 1 a schematic view of a control system in accordance with an embodiment of the present invention.

In an embodiment, the present invention provides means and techniques for improving the reliability with which a flow of fluid can be inhibited. In accordance with the teachings of the present invention, this can be achieved, inter alia, by providing at least two valves that regulate the fluid flow, one of the valves being controlled by a controller of a first type, e.g. a hydraulic controller, the other valves being by a controller of a second type, e.g. an electrical controller.

In accordance with a first aspect, the present invention describes a control system comprising a first valve and a second valve. A valve can have an inlet and an outlet, the valve being configured to adjust a degree to which a fluid can flow between the inlet and the outlet. The valve can be configured to adjust the degree of fluid flow between the inlet and the outlet selectively, e.g. in response to one or more control signals.

For example, the valve can be configured to adopt, in response to one or more control signals, a closed state in which the flow of fluid between the inlet and outlet is blocked, a fully open state that allows a substantially unobstructed flow of fluid between the inlet and outlet, and a plurality of intermediate states (also termed "partially open states") between the closed state and the fully open state, the flow of fluid between the inlet and outlet being correspondingly partially obstructed in the respective intermediate states. The blocking of fluid flow in the closed state can be absolute. In other words, the valve can be configured to prevent absolutely any flow of fluid through the valve, i.e. between the inlet and the outlet of the valve, when the valve is in a closed state. Similarly, the valve can be configured to reduce the flow of fluid through the valve by at least 90%, at least 95% or at least 98% when in a closed state as compared to a fully open state, e.g. as measured when the fluid in the valve is at a maximal rated pressure of the valve.

The first valve and/or the second valve (hereinafter simply "first/second valve") can be configured to selectively block a flow of fluid through a flow line. In other words, the first/second valve can be provided along the flow line, e.g. between respective sections of the flow line. For example, the first/second valve can have an inlet and an outlet, the inlet of the respective valve being in 1:1, i.e. lossless, fluid connection with one section of the flow line, the outlet of the respective valve being in 1:1 fluid connection with another section of the flow line, and the valve selectively blocking a flow of fluid from the inlet to the outlet, i.e. from said one section of the flow line to said another section of the flow line.

The first and second valves can be provided in series. In other words, the first valve can selectively block a flow of fluid between a first section of the flow line and a second section of the flow line, and the second valve can selectively block a flow of fluid between the second section of the flow line and a third section of the flow line. Similarly, the first and second valves can be provided along the flow line such that a flow of fluid between a first location in the flow line and a second location in the flow line is blocked if either of the first and second valves is in a closed state. For example, the first and second valves can be provided such that a flow of fluid to a consumer, e.g. a turbine, from a source is blocked if either of the first and second valves is in a closed state, e.g. if an emergency shut-off signal is input to either of the first and second valves.

A section of flow line may be understood as an element that guides a flow of fluid from one location to at least one other location without loss or without substantial loss. Sections of flow line may constitute an element of the control system. The sections of flow line may cooperate with the first/second valve, i.e. may be provided in (1:1) fluid communication with the respective inlet/outlet of the first/second valve, to form an overall flow line, i.e. the flow line. The (sections of) flow line may include sections of pipe or tube and may be of metal, plastic or other material suitable to constrain the fluid. The (sections of) flow line may include other elements such as valves, gauges, chambers, etc.

The first valve can be configured to selectively block a flow of fluid through the first valve in response to a first emergency shut-off signal, i.e. in response to a first signal indicative of a possible emergency situation. The second valve can be configured to selectively block a flow of fluid through the second valve in response to a second emergency shut-off signal, i.e. in response to a second signal indicative of a possible emergency situation.

A binary, multi-level or analog control signal can be used to communicate the first/second emergency shut-off signal to the respective valve. For example, a control signal that communicates the first/second emergency shut-off signal can be a binary signal, e.g. a binary signal indicative of whether a possible emergency situation has been detected. A control signal of zero current, zero volts or other low voltage, e.g. relative to ground, may be chosen as being indicative of a possible emergency situation, e.g. to ensure that a low/zero current/voltage signal occurring as a result of a power outage is perceived as a possible emergency situation. Similarly, a control signal of zero pressure or other low-pressure state, e.g. relative to the ambient pressure in the environment of the valve, may be chosen as being indicative of a possible emergency situation. Similarly, a control signal having a signal value in a predetermined range or above/below a predetermined threshold can be indicative of a possible emergency situation. The emergency shut-off signal may be, but need not be indicative of an actual emergency.

The first emergency shut-off signal can be of a first signal type, and the second emergency shut-off signal can be of a second signal type that is different from the first signal type. In other words, a control signal that communicates the first emergency shut-off signal can be of a first signal type, and a control signal that communicates the second emergency shut-off signal can be of a second signal type that is different from the first signal type. In this manner, the system is more robust against potentially noxious influences and disturbances, because these are less likely to affect both of the dissimilar signal types in the same manner. In addition, crosstalk between the first emergency shut-off signal and the second emergency shut-off signal can be avoided. For example, the first emergency shut-off signal can be a hydraulic signal and the second emergency shut-off signal can be an electrical signal. Similarly, the first/second emergency shut-off signal can be an acoustic, hydraulic, electromagnetic, optical or other type of signal. Accordingly, the aforementioned signal value can be a voltage, a wavelength, a pressure, an intensity, etc. in the area of signal communication.

The first/second valve can be configured to receive power, e.g. electromagnetic or hydraulic power, from a power source for the sake of actuating the valve. A presence/absence of such power may constitute the two binary states of the control signal representing the first/second emergency shut-off signal. For example, an absence of such power may be indicative of a possible emergency situation, i.e. may represent an emergency shut-off signal, and the presence of such power may be indicative of a "normal," non-emergency situation.

The design of valves that adopt a closed state in response to a predetermined signal, e.g. a predetermined acoustic, hydraulic, electromagnetic or optical signal, is not elucidated in detail here. The valve may include an actuator system that, in response to an emergency shut-off signal, actively and/or passively transfers the valve into a closed state, e.g. with the assistance of gravity or other source of potential energy, e.g. a biased spring.

The first/second valve can be configured to switch from any open state, i.e. from a fully or partially open state, to a closed state in less than one second, less than one half a second, or less than one tenth of a second in response to an emergency shut-off signal. For example, the first valve can be configured to switch, in response to a first emergency shut-off signal, from any position that allows a flow of fluid between a first section of a flow line and a second section of the flow line to a blocking position that blocks all flow of fluid between the first section of the flow line and the second section of the flow line in less than one tenth of a second. Similarly, the second valve can be configured to switch, in response to a second emergency shut-off signal, from any position that allows a flow of fluid between a second section of a flow line and a third section of the flow line to a blocking position that blocks all flow of fluid between the second section of the flow line and the third section of the flow line in less than one tenth of a second. The aforementioned fast response times, which might not be necessary for "normal," non-emergency operation of the valve, allow the valve to respond quickly to the emergency and can thus help curtail the severity of the emergency.

The control system may be part of a power system, e.g. a power plant, having a turbine, e.g. a turbine powered by gas or steam. The flow line may be a flow line that delivers a supply of gas or steam to the turbine, e.g. as a source of fuel/power for the turbine. Accordingly, the fluid may be said gas/steam.

The control system may comprise one or more controllers for generating any of the aforementioned control signals. The controllers may include one or more emergency shut-off signal generators for generating the first/second emergency shut-off signal. For the sake of reliability, the controllers/emergency shut-off signal generators may include redundant elements. The controllers/emergency shut-off signal generators may be configured to output predetermined signals only when at least two of the redundant elements output an identical result or when at least two of the redundant elements output differing results.

The control system may comprise an emergency shut-off signal generator having a first switching module, a second switching module and a third switching module, each of the switching modules having a first terminal, a second terminal, a third terminal and a fourth terminal. The first terminal of each of the switching modules can be connected to a common input line. The fourth terminal of each of the switching modules can be connected to a common output line.

As regards the emergency shut-off signal generator, the term "connect" can be understood in the sense of an electrical connection, e.g. in the sense of a connection of no more than several ohms to several tens of ohms.

The emergency shut-off signal generator can have a configuration wherein the second terminal of the first switching module is connected to the third terminal of the second switching module, the second terminal of the second switching module is connected to the third terminal of the third switching module, and the second terminal of the third switching module is connected to the third terminal of the first switching module.

Each of the switching modules can be configured to selectively connect the first terminal of the respective switching module and the second terminal of the respective switching module and to selectively connect the third terminal of the respective switching module and the fourth terminal of the respective switching module, the selective connecting being in response to a respective, i.e. a first/second/third, control signal. As such, each of the switching modules can have the electrical configuration of a double pole single throw relay and can be implemented using a double pole single throw relay.

The respective switching modules may be implemented using any combination of mechanical and/or solid state components, e.g. power transistors. The respective switching modules may be, but need not be identically implemented.

The switching modules may be implemented as individual switching modules or as a single unit, e.g. as a single circuit.

Each of the switching modules can be configured to disconnect the first terminal of the respective switching module and the second terminal of the respective switching module and to disconnect the third terminal of the respective switching module and the fourth terminal of the respective switching module, the disconnecting being in response to a respective, i.e. a first/second/third, control signal of zero current, zero volts or other low voltage, e.g. relative to ground. This ensures that the respective terminals are disconnected in the event of a power outage.

The emergency shut-off signal generator may supply the second emergency shut-off signal. For example, the common output line can constitute a signal line that communicates the second emergency shut-off signal. The common input line can be connected to a voltage source that supplies a HIGH signal, i.e. a voltage that the second valve would not deem to constitute a second emergency shut-off signal. In such a configuration, if any paths between the common input line and the common output line are connected, then the second valve will not register a second emergency shut-off signal and will continue normal operation. Similarly, if all paths between the common input line and the common output line are disconnected, then the second valve will register a second emergency shut-off signal and will block the flow of fluid through the flow line. The voltage source may be an element of the emergency shut-off signal generator.

The control system may comprise a control signal generator that generates a second valve control signal. The second valve may be configured to adjust a flow of fluid between the inlet and the outlet of the second valve in response to the second valve control signal, except when the second valve is blocking a flow of fluid between the inlet and the outlet of the second valve in response to the second emergency shut-off signal. In other words, the second valve can be configured to operate in normal operation, i.e. in response to a second valve control signal, unless the second valve registers a second emergency shut-off signal, in which case the second valve blocks a flow of fluid between the inlet and the outlet of the second valve. In again other words, the second valve can be configured such that the second emergency shut-off signal overrides the second valve control signal.

In accordance with a second aspect, the present invention describes a method for upgrading a control system, e.g. a control system that controls a flow of fluid in a flow line. The preceding remarks re valves, signals, flow lines, etc. apply mutatis mutandis.

The control system to be updated may comprise a first emergency shut-off signal generator, e.g. an emergency shut-off signal generator as described above. The first emergency shut-off signal generator may be configured to generate a first emergency shut-off signal of a first type, e.g. a hydraulic signal.

The control system to be updated may comprise a first valve. The first valve may be configured to block a flow of fluid between an inlet and an outlet of the first valve in response to a signal, e.g. in response to the first emergency shut-off signal. The first valve may regulate a flow of fluid in a flow line. The first valve may be configured to block a flow of fluid between a first section of the flow line and a second section of the flow line in response to a signal. The flow line may be an element of the control system to be updated. Similarly, the first valve may be configured to block a flow of fluid between the inlet and the outlet of the first valve in response to the first emergency shut-off signal and to otherwise adjust a flow of fluid between the inlet and the outlet of the first valve in response to a first valve control signal.

The control system to be updated may comprise a second valve. The second valve may be configured to adjust a flow of fluid between an inlet and an outlet of the second valve in response to a valve control signal. The second valve may regulate a flow of fluid in a flow line, e.g. the aforementioned flow line. The second valve may be configured to adjust a flow of fluid between the second section of the flow line and a third section of the flow line in response to a valve control signal.

The control system to be updated may be part of a power system, e.g. a power plant, having a turbine, e.g. a turbine powered by gas or steam. The flow line may be a flow line that delivers a supply of gas or steam to the turbine, e.g. as a source of fuel/power for the turbine. Accordingly, the fluid may be said gas/steam.

The method may comprise providing a second emergency shut-off signal generator, e.g. an emergency shut-off signal generator as described above. The second emergency shut-off signal generator may be configured to generate a second emergency shut-off signal of a second type, e.g. an electrical signal. The second emergency shut-off signal generator may be configured to generate the second emergency shut-off signal in response to an input set corresponding to any one of a plurality of predetermined potential emergency input sets.

As suggested by the above teaching, generation of the second emergency shut-off signal need not be dependent on occurrence of a single event or of a single combination of events. Instead, the second emergency shut-off signal generator may generate the second emergency shut-off signal in response to any one of a plurality of single events or in response to any one of a plurality of combined events where the respective single events/combined events have been predetermined to be indicative of a potential emergency. The occurrence of such events may be reflected by input of a corresponding input set, e.g. an input set of signals. In this respect, the second emergency shut-off signal generator may receive a plurality of input signals, e.g. a temperature signal obtained by measuring a temperature in a turbine, a pressure signal obtained by measuring a pressure in the turbine and a power signal. Whereas a power signal of zero current or zero volts could indicate a potential emergency, namely a power outage, an abnormally high temperature not exceeding an extreme threshold might not be considered indicative of a potential emergency. However, the same abnormally high temperature in combination with an abnormally high pressure could be considered indicative of a potential emergency.

The method may comprise configuring the second valve to block a flow of fluid between the inlet and the outlet of the second valve, e.g. between the second section of the flow line and the third section of the flow line, in response to the second emergency shut-off signal. The configuring may comprise configuring the second valve to block a flow of fluid between the inlet and the outlet of the second valve in response to said second emergency shut-off signal and to otherwise adjust a flow of fluid between the inlet and the outlet of the second valve in response to a second valve control signal.

By updating the control system such that the second valve can block a flow of fluid in response to a second emergency shut-off signal of a second type, the reliability of the control system can be significantly improved without incurring substantial costs.

FIG. 1 shows a control system in accordance with an embodiment of the present disclosure, e.g. as described hereinabove.

As illustrated in FIG. 1, the control system comprises a first valve 11 and a second valve 12 disposed along a first flow line 10, e.g. as used for regulating a first flow of fuel to a turbine in a power plant. The control system may, as shown, comprise a third valve 21 and a fourth valve disposed along a second flow line 20, e.g. for regulating a second flow of fuel to the turbine.

In the embodiment of FIG. 1, first valve 11 receives a first control signal that is a hydraulic signal, e.g. a pressure signal, via signal line 81. First valve 11 is configured to block a flow of fluid between an inlet and an outlet of first valve 11, i.e. through flow line 10, in response to an emergency shut-off signal communicated by the first control signal. Similarly, second valve 12 receives a second control signal that is an electrical signal via signal line 82 and is configured to block a flow of fluid between an inlet and an outlet of second valve 12, i.e. through flow line 10, in response to an emergency shut-off signal communicated by the second control signal.

Similarly, each of third and fourth valves 21, 22 may be configured to block a flow of fluid through second flow line 12 in response to an emergency shut-off signal communicated by the first/second control signal.

The control system illustrated in FIG. 1 and as described hereinbelow comprises numerous other elements not mandated by the teachings of the present disclosure. Inter alia, the control system is illustrated as comprising, as individually optional features, four sensors 60A-60D, a data bus 70, a protection controller 30, a first emergency shut-off signal generator 31, a second emergency shut-off signal generator 32, a pressure source 41, an electrical power supply 42, an open loop controller 51 and a closed loop controller 52.

Sensors 60A-60D measure various parameters of the controlled system, e.g. a rotational speed, a combustion temperature and a fuel injection pressure of the turbine. Sensor signals respectively output from sensors 60A-60D are communicated via data bus 70 to other elements of the control system, e.g. to protection controller 30 and to open loop controller 51.

Open loop controller 51 can process the received sensor signals to generate a control signal that is fed via signal line 83 to first valve 11. First valve 11 can be configured to regulate a flow of fluid through the valve as dictated by the control signal from open loop controller 51 except upon receipt of an emergency shut-off signal, in which case first valve 11 blocks the flow of fluid through the valve as described above. In other words, first valve 11 can interpret an emergency shut-off signal as overriding the "normal" control signal received e.g. from open loop controller 51.

Closed loop controller 52 can generate a control signal that is fed via signal line 84 to second valve 12. Second valve 12 can be configured to regulate a flow of fluid through the valve as dictated by the control signal from closed loop controller 52 except upon receipt of an emergency shut-off signal, in which case second valve 12 blocks the flow of fluid through the valve as described above. In other words, second valve 12 can interpret an emergency shut-off signal as overriding the "normal" control signal received e.g. from closed loop controller 52.

Protection controller 30 can be configured to monitor the sensor signals to identify potential emergency situations and to accordingly output one or more warning signals as necessary. In this respect, protection controller 30 may comprise redundant elements, each of the redundant elements being configured to output a respective warning signal if the monitored sensor signals match any of a plurality of predetermined signal patterns/predetermined signal values indicative of a potential emergency situation. Each of the redundant elements may moreover be configured to output a respective warning signal if a circuit fault within the respective element or if a system abnormality outside the respective element is detected. The warning signals may be represented by a LOW signal state to ensure that a warning signal is communicated in the event of a power outage or a catastrophic circuit failure, e.g. within the protection controller 30.

In FIG. 1, protection controller 30 is shown as outputting a three-channel output to first emergency shut-off signal generator 31 and a three-channel output to second emergency shut-off signal generator 32. First emergency shut-off signal generator 31 can be configured to output a first emergency shut-off signal to first valve 11 via signal line 81 if a warning signal is detected on at least two of the three channels output from protection controller 30, i.e. in the event of a potential emergency. Similarly, second emergency shut-off signal generator 32 can be configured to output a second emergency shut-off signal to second valve 12 via signal line 82 if a warning signal is detected on at least two of the three channels output from protection controller 30, i.e. in the event of a potential emergency.

First emergency shut-off signal generator 31 receives a pressurized fluid from pressure source 41 via piping 91. Signal line 81 may also be implemented in the form of piping. First emergency shut-off signal generator 31 can be configured to communicate the pressurized fluid received via piping 91 into signal line 81 under "normal" operating conditions, the pressurized fluid communicated into signal line 81 acting as a trigger signal for actuating first valve 11. Likewise, first emergency shut-off signal generator 31 can be configured to terminate communication of the pressurized fluid from piping 91 into signal line 81 in the event of a potential emergency, e.g. as discussed supra. Thus, the absence of pressurized fluid in signal line 81 can constitute a first emergency shut-off signal. Accordingly, first valve 11 can be configured to automatically move to a closed state upon absence of pressurized fluid in signal line 81.

Second emergency shut-off signal generator 32 receives electrical power from electrical power source 42 via power line 92. Signal line 82 may also be implemented in the form of a power line. Second emergency shut-off signal generator 32 can be configured to communicate the electrical power received via power line 92 into signal line 82 under "normal" operating conditions, the electrical power communicated into signal line 82 acting as a source of power for actuating second valve 12. Likewise, second emergency shut-off signal generator 32 can be configured to terminate communication of the electrical power from power line 92 into signal line 82 in the event of a potential emergency, e.g. as discussed supra. Thus, the absence of electrical power in signal line 82 can constitute a second emergency shut-off signal. Accordingly, second valve 12 can be configured to automatically move to a closed state upon absence of electrical power in signal line 82.

The above applies mutatis mutandis for the third and fourth valves 21, 22 as indicated by FIG. 1.

Figure 2:
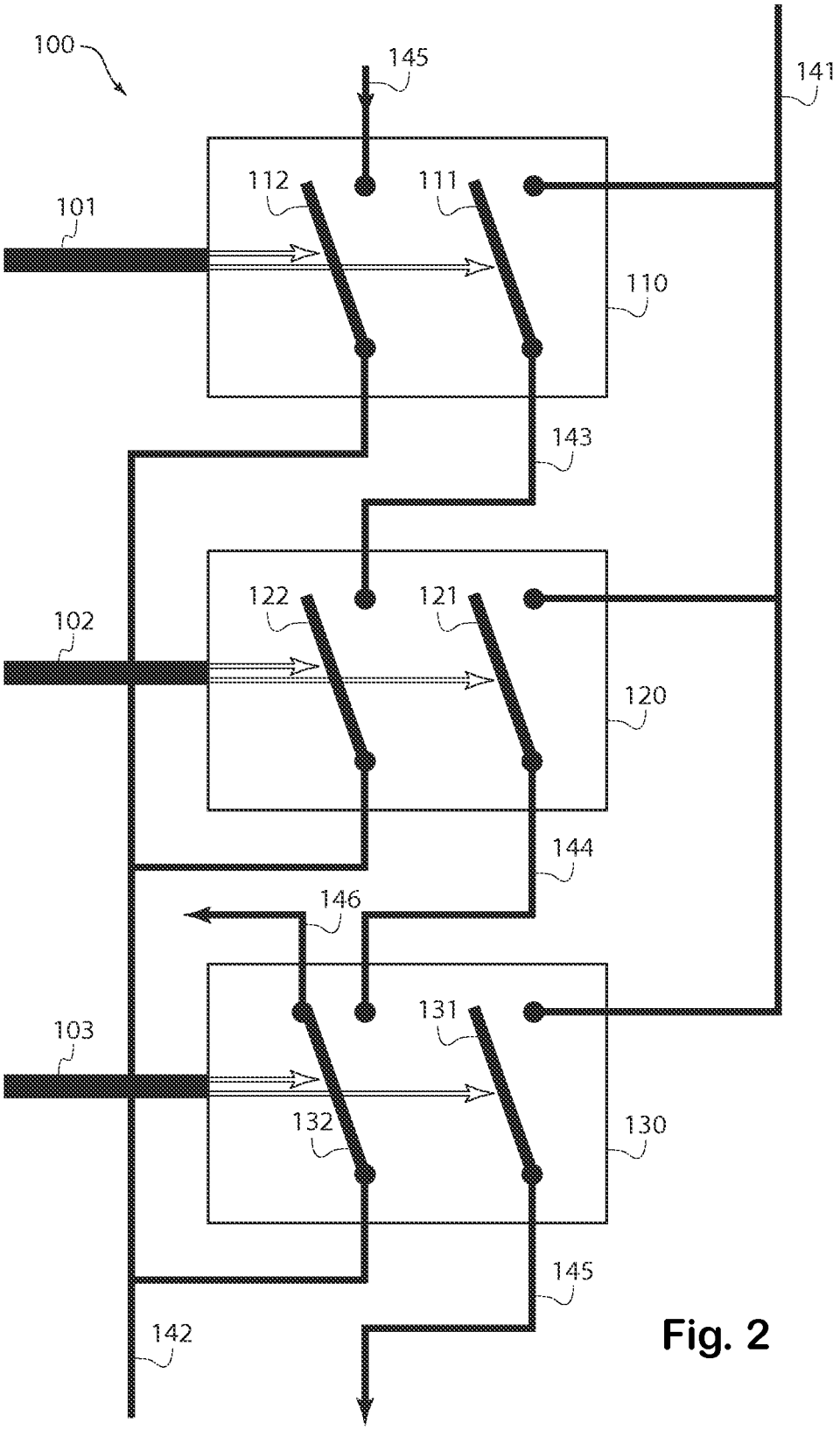
FIG. 2 a schematic view of an emergency shut-off signal generator in accordance with an embodiment of the present invention.

FIG. 2 shows an emergency shut-off signal generator 100 in accordance with an embodiment of the present disclosure, e.g. as described hereinabove.

Emergency shut-off signal generator 100 has a first switching module 110, a second switching module 120 and a third switching module 130. Each of the three switching modules 110, 120 and 130 has a first terminal, a second terminal, a third terminal and a fourth terminal. The respective first terminal of each switching module 110, 120 and 130 is connected, e.g. is in electrical connection with, a common input line 141. The respective fourth terminal of each switching module 110, 120 and 130 is connected, e.g. is in electrical connection with, a common output line 142.

First switching module 110 comprises a first switching element 111 that selectively establishes a connection, e.g. an electrical connection, between the first terminal and the second terminal of first switching module 110 in response to a signal received from a first signal line 101. First switching module 110 moreover comprises a second switching element 112 that selectively establishes a connection, e.g. an electrical connection, between the third terminal and the fourth terminal of first switching module 110 in response to the signal received from first signal line 101.

Second switching module 120 comprises a first switching element 121 that selectively establishes a connection, e.g. an electrical connection, between the first terminal and the second terminal of second switching module 120 in response to a signal received from a second signal line 102. Second switching module 120 moreover comprises a second switching element 122 that selectively establishes a connection, e.g. an electrical connection, between the third terminal and the fourth terminal of second switching module 120 in response to the signal received from second signal line 102.

Third switching module 130 comprises a first switching element 131 that selectively establishes a connection, e.g. an electrical connection, between the first terminal and the second terminal of third switching module 130 in response to a signal received from a third signal line 103. Third switching module 130 moreover comprises a second switching element 132 that selectively establishes a connection, e.g. an electrical connection, between the third terminal and the fourth terminal of third switching module 130 in response to the signal received from third signal line 103.

As such, each of switching modules 110, 120 and 130 can have the electrical configuration of a double pole single throw relay and can be implemented using a double pole single throw relay.

The respective switching modules 110, 120 and 130 may be implemented using any combination of mechanical and/or solid state components, e.g. power transistors. The respective switching modules 110, 120 and 130 may be, but need not be identically implemented. Switching modules 110, 120 and 130 may be implemented as individual switching modules or as a single unit, i.e. as a single circuit.

The second terminal of first switching module 110 is connected, e.g. is in electrical connection with, the third terminal of second switching module 120 via line 143. The second terminal of second switching module 120 is connected, e.g. is in electrical connection with, the third terminal of third switching module 130 via line 144. The second terminal of third switching module 130 is connected, e.g. is in electrical connection with, the third terminal of first switching module 110 via line 145. For the sake of easier illustration, line 145 is shown as two separate segments, the true connection of these segments being indicated by arrows.

Emergency shut-off signal generator 100 can be used in a control system as shown in FIG. 1. For example, second emergency shut-off signal generator 32 can be implemented using emergency shut-off signal generator 100. In such a case, the three-channel output from protection controller 30 would constitute first, second and third signal lines 101, 102 and 103, power line 92 would constitute common input line 141 and signal line 82 would constitute common output line 142.

While various embodiments of the present invention have been disclosed and described in detail herein, it will be apparent to those skilled in the art that various changes may be made to the configuration, operation and form of the invention without departing from the spirit and scope thereof. In particular, it is noted that the respective features of the invention, even those disclosed solely in combination with other features of the invention, may be combined in any configuration excepting those readily apparent to the person skilled in the art as nonsensical. Likewise, use of the singular and plural is solely for the sake of illustration and is not to be interpreted as limiting.

LIST OF REFERENCE SIGNS

10 first flow line
11 first valve
12 second valve
20 second flow line
21 third valve
22 fourth valve
30 protection controller
31 first emergency shut-off signal generator
32 second emergency shut-off signal generator
41 pressure source
42 power source
51 open loop controller
52 closed loop controller
60 sensor
70 data bus
81 signal line
82 signal line
83 signal line
84 signal line
91 piping
92 power line
100 emergency shut-off signal generator
110 first switching module
111 first switching element
112 second switching element
120 second switching module
121 first switching element
122 second switching element
130 third switching module
131 first switching element
132 second switching element
141 common input line
142 common output line
143 line
144 line
145 line

What is claimed is:

1. A control system comprising:

a first valve configured to block a fluid flow between a first section of a flow line and a second section of the flow line in response to a first emergency shut-off signal of a first signal type;

a second valve configured to block the second section of the flow line and a third section of the flow line in response to a second emergency shut-off signal of a second signal type, wherein the first signal type differs from the second signal type; and an emergency shut-off signal generator including:

a first switching module including a first terminal connected to an input line, a second terminal, a third terminal, and a fourth terminal connected to an output line;

a second switching module including a first terminal connected to the input line, a second terminal, a third terminal, and a fourth terminal connected to the output line, wherein the second terminal of the first switching module is connected to the third terminal of the second switching module; and a third switching module including a first terminal connected to the input line, a second terminal, a third terminal, and a fourth terminal connected to the output line, wherein the second terminal of the second switching module is connected to the third terminal of the third switching module and the second terminal of the third switching module is connected to the third terminal of the first switching module, and wherein the first switching module is configured to selectively connect the first terminal of the first switching module and the second terminal of the first switching module and to selectively connect the third terminal of the first switching module and the fourth terminal of the first switching module in response to a first control signal, and wherein the second switching module is configured to selectively connect the first terminal of the second switching module and the second terminal of the second switching module and to selectively connect the third terminal of the second switching module and the fourth terminal of the second switching module in response to a second control signal, and wherein the third switching module is configured to selectively connect the first terminal of the third switching module and the second terminal of the third switching module and to selectively connect the third terminal of the third switching module and the fourth terminal of the third switching module in response to a third control signal.

2. The control system as recited in claim 1, wherein the first emergency shut-off signal includes a hydraulic signal, and wherein the second emergency shut-off signal includes an electrical signal.

3. The control system as recited in claim 1, wherein the first valve is configured to switch from a position allowing a fluid flow between the first section and the second section to a blocking position blocking all fluid flow between the first section and the second section in less than one tenth of a second in response to the first emergency shut-off signal.

4. The control system as recited in claim 1, wherein the second valve is configured to switch from a position allowing a fluid flow between the second section and the third section to a blocking position blocking all fluid flow between the second section and the third section in less than one tenth of a second in response to the second emergency shut-off signal.

5. The control system as recited in claim 1, wherein the first switching module is configured to disconnect the first terminal of the first switching module from the second terminal of the first switching module and the third terminal of the first switching module from the fourth terminal of the first switching module in response to a first control signal of zero current, and wherein the second switching module is configured to disconnect the first terminal of the second switching module from the second terminal of the second switching module and the third terminal of the second switching module from the fourth terminal of the second switching module in response to a second control signal of zero current, and wherein the third switching module is configured to disconnect the first terminal of the third switching module from the second terminal of the third switching module and the third terminal of the third switching module from the fourth terminal of the third switching module in response to a third control signal of zero current.

6. The control system as recited in claim 1, wherein the emergency shut-off signal generator is configured to supply the second emergency shut-off signal.

7. A control system comprising:

a first valve configured to block a fluid flow between a first section of a flow line and a second section of the flow line in response to a first emergency shut-off signal of a first signal type;

a second valve configured to block the second section of the flow line and a third section of the flow line in response to a second emergency shut-off signal of a second signal type, wherein the first signal type differs from the second signal type; and a control signal generator configured to generate a second valve control signal, the second valve being configured to adjust a fluid flow between the second section of the flow line and the third section of the flow line in response to the second valve control signal except when the second valve is blocking the second section and the third section in response to the second emergency shut-off signal.

8. A method for upgrading a control system controlling a fluid flow in a flow line, the control system including a first emergency shut-off generator configured to generate a first emergency shut-off signal of a first type, a first valve configured to block a fluid flow between a first section of the flow line and a second section of the flow line in response to the first emergency shut-off signal, and a second valve configured to adjust a fluid flow between the second section of the flow line and a third section of the flow line in response to a valve control signal, the method comprising:

providing a second emergency shut-off signal generator configured to generate a second emergency shut-off signal of a second signal type in response to an input set corresponding to at least one of a plurality of predetermined potential emergency input sets; and configuring the second valve to block a fluid flow between the second section of the flow line and a third section of the flow line in response to the second emergency shut-off signal.

9. The method as recited in claim 8, wherein the first valve adjusts a fluid flow between the first section of the flow line and the second section of the flow line in response to a first valve control signal except when blocking a fluid flow between the first section of the flow line and the second section of the flow line in response to the first emergency shut-off signal.

10. The method as recited in claim 8, wherein the configuring includes configuring the second valve to adjust a fluid flow between the second section of the flow line and a third section of the flow line in response to a second valve control signal except when the second valve is blocking a fluid flow.

11. The method as recited in claim 8, wherein the first emergency shut-off signal includes a hydraulic signal and the second emergency shut-off signal includes an electrical signal.

12. The method as recited in claim 8, wherein the second emergency shut-off generator includes:

a first switching module including a first terminal connected to an input line, a second terminal, a third terminal, and a fourth terminal connected to an output line;

a second switching module including a first terminal connected to the input line, a second terminal, a third terminal, and a fourth terminal connected to the output line, wherein the second terminal of the first switching module is connected to the third terminal of the second switching module; and a third switching module including a first terminal connected to the input line, a second terminal, a third terminal, and a fourth terminal connected to the output line, wherein the second terminal of the second switching module is connected to the third terminal of the third switching module and the second terminal of the third switching module is connected to the third terminal of the first switching module, and wherein the first switching module selectively connects the first terminal of the first switching module and the second terminal of the first switching module and selectively connects the third terminal of the first switching module and the fourth terminal of the first switching module in response to a first control signal, and wherein the second switching module selectively connects the first terminal of the second switching module and the second terminal of the second switching module and selectively connects the third terminal of the second switching module and the fourth terminal of the second switching module in response to a second control signal, and wherein the third switching module selectively connects the first terminal of the third switching module and the second terminal of the third switching module and selectively connects the third terminal of the third switching module and the fourth terminal of the third switching module in response to a third control signal.

13. The method as recited in claim 12, wherein the first switching module disconnects the first terminal of the first switching module from the second terminal of the first switching module and disconnects the third terminal of the first switching module from the fourth terminal of the first switching module in response to a first control signal of zero current, and wherein the second switching module disconnects the first terminal of the second switching module from the second terminal of the second switching module and disconnects the third terminal of the second switching module from the fourth terminal of the second switching module in response to a second control signal of zero current, and wherein the third switching module disconnects the first terminal of the third switching module from the second terminal of the third switching module and disconnects the third terminal of the third switching module from the fourth terminal of the third switching module in response to a third control signal of zero current.

* * * * *